US008118333B2

(12) United States Patent
Lee et al.

(10) Patent No.: US 8,118,333 B2
(45) Date of Patent: Feb. 21, 2012

(54) LOCK DEVICE

(75) Inventors: Jen-Hsiang Lee, Taipei (TW); Po-Li Hsieh, Douliou (TW); Chai-Cheng Lu, Jhonghe (TW)

(73) Assignee: Quanta Computer Inc., Tao Yuan Shien (TW)

( * ) Notice: Subject to any disclaimer, the term of this patent is extended or adjusted under 35 U.S.C. 154(b) by 584 days.

(21) Appl. No.: 12/314,130

(22) Filed: Dec. 4, 2008

(65) Prior Publication Data

US 2009/0320534 A1 Dec. 31, 2009

(30) Foreign Application Priority Data

Jun. 27, 2008 (TW) ..... 97211455 U

(51) Int. Cl.
*E05C 1/08* (2006.01)

(52) U.S. Cl. ..... 292/163; 292/166; 292/169.18; 292/DIG. 4; 292/DIG. 37

(58) Field of Classification Search ..... 292/163, 292/166, 168, 170, 169.18, 169.19, DIG. 37, 292/121, 127, DIG. 4, 169, 140, 145, 150
See application file for complete search history.

(56) References Cited

U.S. PATENT DOCUMENTS

| | | | | |
|---|---|---|---|---|
| 2,113,747 | A * | 4/1938 | Roedding et al. | 292/127 |
| 6,460,902 | B1 * | 10/2002 | Kyle | 292/165 |
| 6,669,047 | B2 * | 12/2003 | Wooderson et al. | 220/316 |
| 7,695,080 | B2 * | 4/2010 | Chen et al. | 312/333 |

* cited by examiner

*Primary Examiner* — Thomas A Beach
*Assistant Examiner* — Mark Williams
(74) *Attorney, Agent, or Firm* — Thomas, Kayden, Horstemeyer & Risley, LLP

(57) ABSTRACT

The invention discloses a lock device. The lock device is used for detachably mounting a cover on a base. A recess is formed on the cover. A first hole is formed on the bottom of the recess, and a first retainer is extended out of the bottom of the recess. The lock device includes a first sliding member, a first elastomer, and a second sliding member. A column which is capable of passing through the first hole is formed on the first sliding member. A second retainer which is used for the first retainer to lock is formed on the second sliding member. When the first sliding member slides toward the base along a first axle, the column pushes the second retainer to make the second sliding member slide toward a second axle, so as to make the second retainer separate from the first retainer.

9 Claims, 7 Drawing Sheets

LOCK DEVICE

BACKGROUND OF THE INVENTION

1. Field of the Invention

The invention relates to a lock device, and more particularly, to a lock device whose release button and cover are integrally designed to make the cover lock the base firmly.

2. Description of the Prior Art

If a cover (e.g., a cap, door, etc.) was designed to perform the actions of "locking" or "releasing" relative to a base in the past, a known approach was to make the cover lock a fastener on the base. Besides, a release button was disposed on the base beyond the cover. Each of the foregoing release button and the cover was an individual component. When a user closed the foregoing cover to the base, the cover would push away the fastener of the base first and got locked later. When the user pushed the release button, the release button would push the fastener of the base away to make the fastener release from the cover. Moreover, after the user took off the cover and released the release button, the fastener which was pushed away by the release button would return back to its original position.

With the development of information and the progress of technology, applications of electronic products are getting more and more universal. In order to cope with the developments of industry and commerce, and the frequent and close interaction of business, almost all electronic products are produced to cope with the requirements of lightness and impact size. It can be obviously known that the designs of space are getting very strict and limited. That is to say, the above-mentioned approach and the mechanism of designing a button to release the lock situation at the space beyond the cover will confront a strict test in space design and limit the application scope.

In order to solve the above-mentioned problems, the integration of the foregoing cover into release button is the first approach which can be directly thought of. In other words, the foregoing cover can operated as a release button to comply with the limitations of space design. Thereby, when the user pushes the foregoing cover to close on the base, the cover will push the retainer of the base away and then gets locked; when the user pushes the cover downward, the cover will push the retainer of the base away, so as to release the lock situation between the retainer and the cover.

Besides, if one wants to realize the functions of "pushing to lock" and "pushing to release" toward a cover on the same axle in the profile of the cover, a door lock device will be regarded as a major lock structure in the second approach. Please refer to FIG. 1. FIG. 1 is a cross-sectional view illustrating a known door lock device 20. As shown in FIG. 1, the door lock device 20 has a housing 21 with proper thickness. A flange 22 is formed at one side of the housing 21, and two hooks 23 are formed at both sides of the housing 21. A locking space 26 with a universal thickness of 2 mm is defined between the flange 22 and the hooks 23. Besides, an accommodating trough is formed in the interior of the housing 21 so that an elastic hook 25 which can move backward and forward can be adapted to be disposed in the accommodating trough. An opened clip arm 24 is formed at the front end of the elastic hook 25. The assembling method of the door lock device 20 is to form a positioning hole on a straight plate 11 of a casing 10 for the door lock device 20 to position, and to force the clip arm 24 with a lock 31 which is formed on a corresponding door 30 in advance. When the lock 31 on the door 30 is pushed into the clip arm 24 of the door lock device 20, the door 30 can be positioned on the casing 10, and the lock 31 can be mounted in the locking space 26.

In general, the method and mechanism which are used by the foregoing door lock device to release the lock situation can be often seen on door designs of middle-sized or large-sized electronic equipment, such as a photocopier, a printer, a computer, etc. Besides, a common ball-point pen in the market has a switch button. When the switch button is pushed, the pen point of the ball-point pen will expose out for writing; when the switch button is pushed again, the pen point of the ball-point pen will return back to its original position and be stored away. The mechanism is the same as that of the foregoing second approach.

However, the foregoing first approach will encounter the follow-up problems in practical operations. After pushing the cover to push the retainer of the base away, the user must take off the cover in a very short time (approximately in a flash), or the retainer which was pushed away will return to its original position and keep the cover in the lock situation. Therefore, if the foregoing first approach is adopted, the take-off speed of the cover must be faster than the returning speed of the retainer of the base, after pushing the cover.

Moreover, although having the advantages of ease to disassemble and ease to assemble, the second approach still has the follow-up problems. The door lock device is always on the same axle during locking and releasing, and an excess stroke is used to achieve the functions of locking and releasing. Therefore, an idle stroke must be reserved under the cover, which makes the cover be supported improperly and fix on the base unstably. This situation may cause a cover to be released and separated from the base of goods due to an unexpected crash or users' inadvertent pushes during the transportation of the goods. The situation is very dangerous for packing an electronic product (e.g., a hard disk) which is easily damaged. Furthermore, another situation will occur by utilizing the door lock device; that is, when the foregoing excess stroke is not enough, the cover will not be switched and returned back.

Accordingly, the major objective of the invention is to provide a lock device whose release button and cover are integrally designed, so as to make the cover to firmly lock the base. Moreover, by controlling the particular spring stroke which is designed under the release button, the function of taking off the cover under the release situation can be achieved. Thus, the lock device of the invention can achieve the function of locking and releasing certainly and solve the above-mentioned problems.

SUMMARY OF THE INVENTION

An objective of the invention is to provide a lock device. The lock device is used to detachably mount a cover on a base. A recess is formed on the cover. A first hole is formed on the bottom of the recess, and a first retainer is extended out of the bottom of the recess. A groove is formed on the base. The lock device includes a first sliding member, a first elastomer, and a second sliding member. The first sliding member is adapted to be accommodated in the recess and is capable of limitedly sliding along a first axle relative to the cover. A column which is capable of passing through the first hole is formed on the first sliding member. The first elastomer is disposed between the cover and the first sliding member along the first axle and is used to support the first sliding member. The second sliding member is adapted to be accommodated in the groove and is capable of limitedly sliding along a second axle relative to the base. A second retainer which is used for the first retainer to lock is formed on the second sliding member. When the first sliding member slides toward the base along the first axle, the column will push the second retainer to make the second sliding member to slide along the second axle, so as to make the second retainer separate from the first retainer.

Accordingly, the release button and cover of the lock device according to the invention are integrally designed, so as to make the cover lock the base firmly. Moreover, by controlling the particular spring stroke which is designed under the release button, the function of taking off the cover under the release situation can be achieved.

The advantage and spirit of the invention may be understood by the following recitations together with the appended drawings.

BRIEF DESCRIPTION OF THE APPENDED DRAWINGS

DETAILED DESCRIPTION OF THE INVENTION

The invention provides a lock device. And more particularly, the release button and cover of the lock device are integrally designed, so as to make the cover lock the base firmly. With the embodiment of the invention below, the features and spirits of the invention will be hopefully well described.

Figure 1:
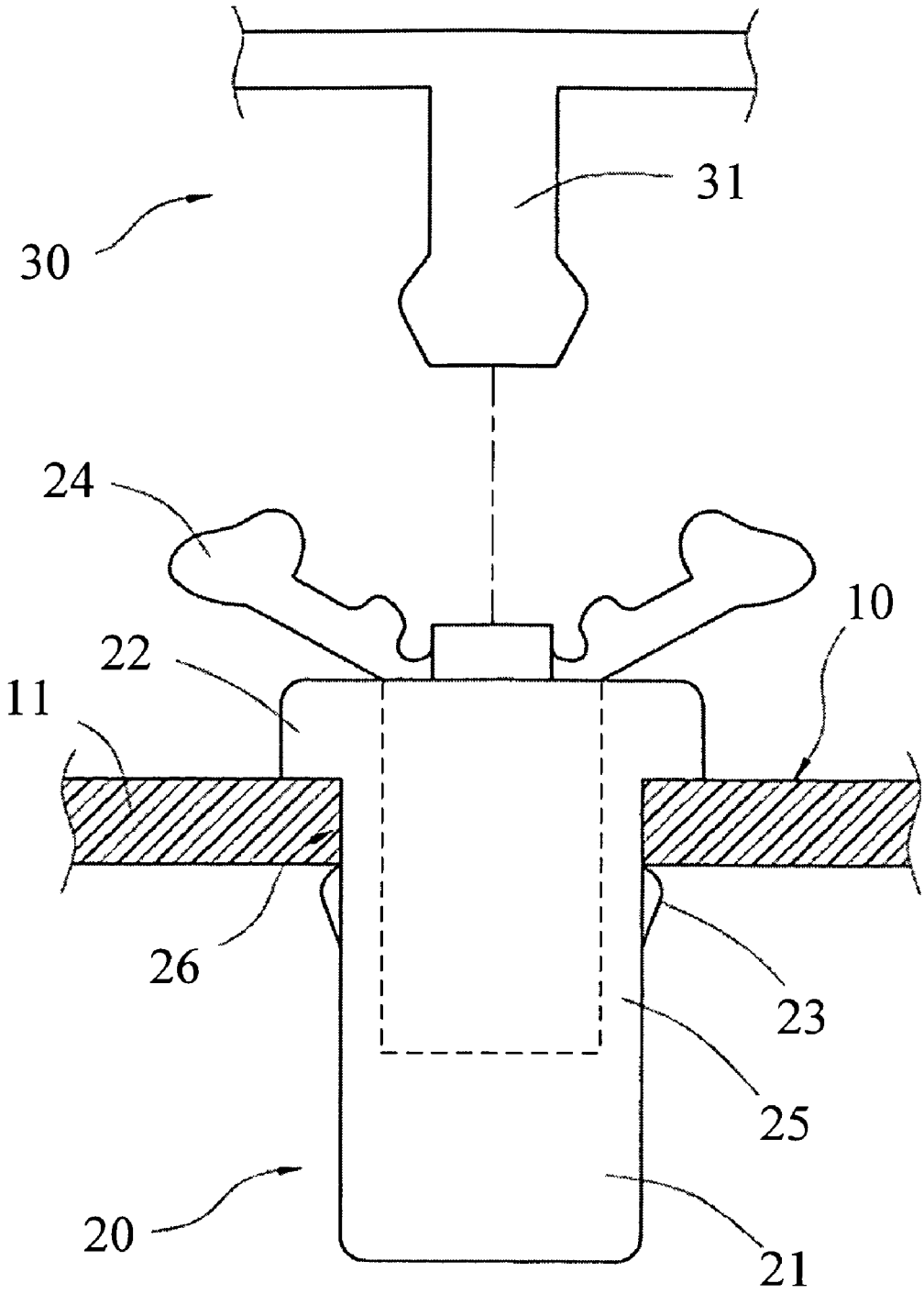
FIG. 1 (Prior art)
FIG. 1 is a cross-sectional view illustrating a known door lock device 20.
Figure 2:
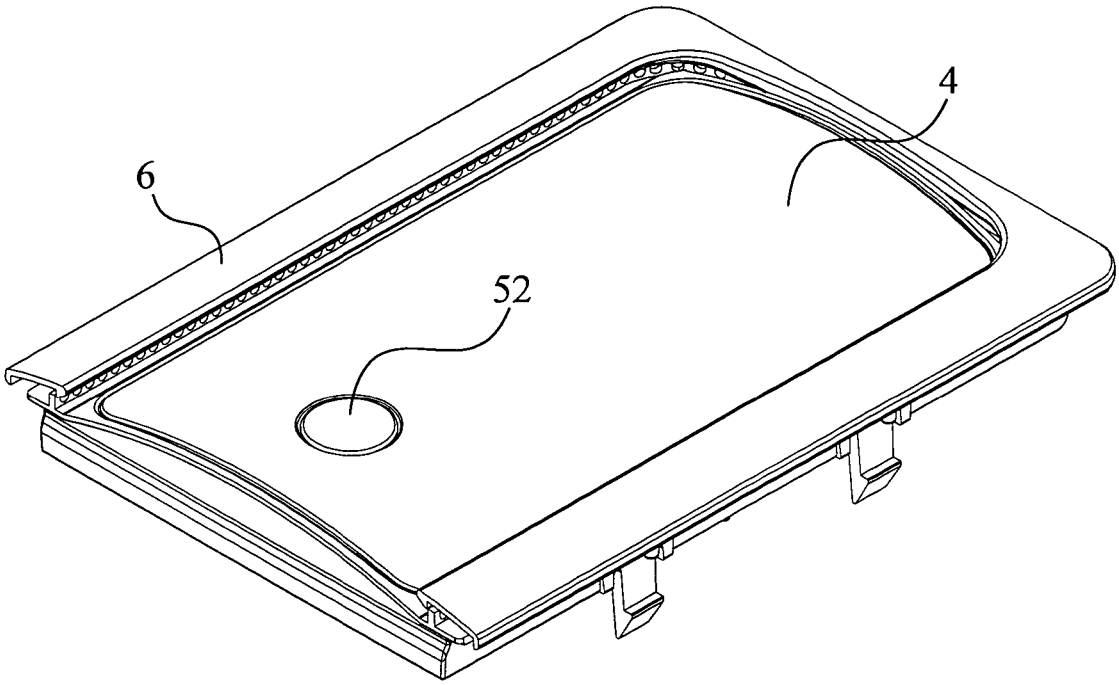
FIG. 2 is an appearance drawing illustrating a lock device according to a preferred embodiment of the invention.

Please refer to FIG. 2. FIG. 2 is an appearance drawing illustrating a lock device according to a preferred embodiment of the invention. As shown in FIG. 2, the lock device of the invention is mainly to detachably mount a cover 4 on a base 6 by pressing a first sliding member (i.e., the foregoing release button) 52. The details of the necessary components in every embodiments of the invention will be described and explained below.

Figure 3:
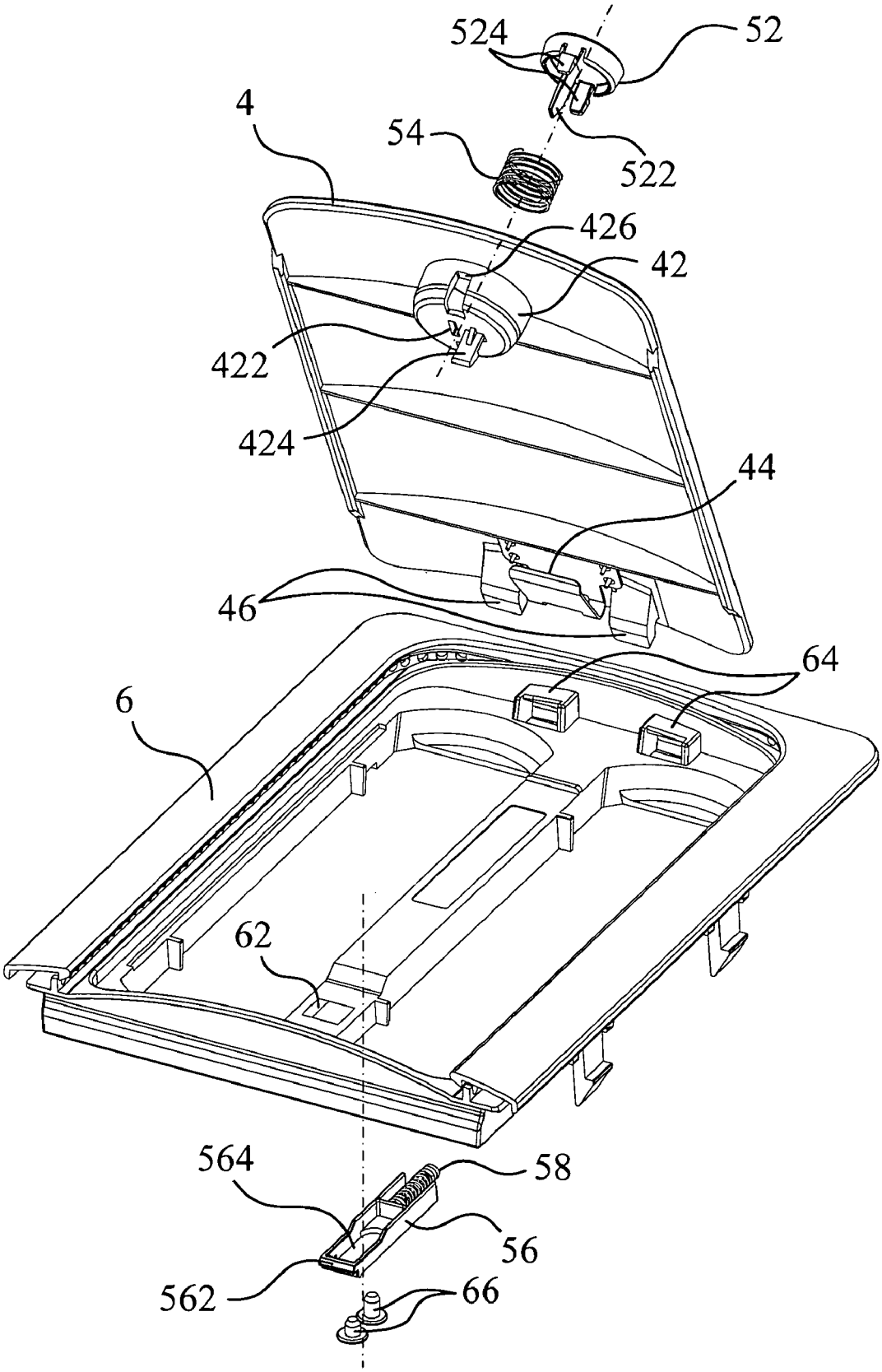
FIG. 3 is an explosion diagram illustrating the lock device in FIG. 2.

Please refer to FIG. 3. FIG. 3 is an explosion diagram illustrating the lock device in FIG. 2. As shown in FIG. 3, a recess 42 is formed on the cover 4. A first hole 422 is formed on the bottom of the recess 42, and a first retainer 424 is extended out of the bottom of the recess 42. Besides, a groove 62 is formed on the base 6. The lock device includes the first sliding member 52, a first elastomer 54, and a second sliding member 56.

Figure 4A:
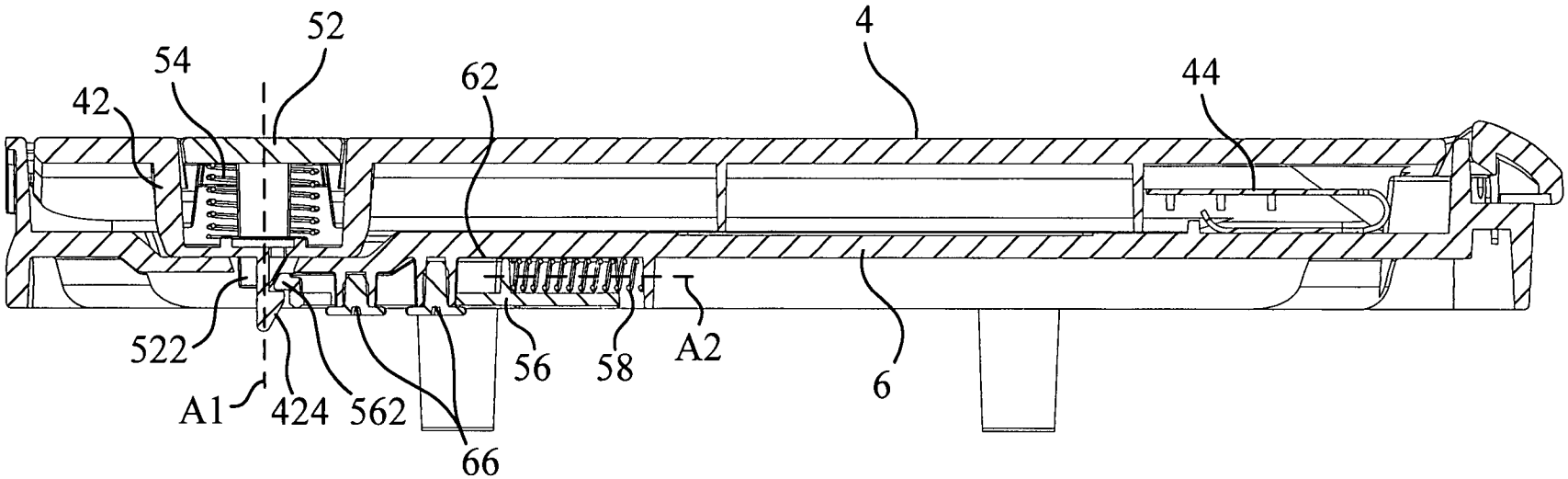
FIG. 4A is a cross-sectional view illustrating the lock device in FIG. 2, wherein the first sliding member is not pressed.

Please refer to FIG. 4A. FIG. 4A is a cross-sectional view illustrating the lock device in FIG. 2, wherein the first sliding member 52 is not pressed. The shape of the first sliding member 52 is adapted to be accommodated in the recess 42 on the cover 4 and is capable of limitedly sliding along a first axle A1 relative to the cover 4. A column 522 which is capable of passing through the first hole 422 is formed on the first sliding member 52. The first elastomer 54 is disposed between the cover 4 and the first sliding member 52 along the first axle A1. The first elastomer 54 is used to support the first sliding member 52. When the first sliding member 52 is pressed, the elastomer 54 will generate an elastic force which can push against the first sliding member 52 because of being compressed. The shape of the second sliding member 56 is adapted to be accommodated in the groove 62 and is capable of limitedly sliding along a second axle A2 relative to the base 6. A second retainer 562 which is used for the first retainer 424 to lock is formed on the second sliding member 56.

As shown in FIG. 3, the cover 4 includes a first engagement portion 46, and the base 6 includes a second engagement portion 64 corresponding to the first engagement portion 46. The cover 4 is mounted to the base 6 by engaging the first engagement portion 46 to the second engagement portion 64 of the base 6 and locking the first retainer 424 of the first sliding member 52 to the second retainer 562 of the second sliding member 56. In the embodiment, the foregoing first engagement portion 46 on the cover 4 can be a block which is extended from the portion adjacent to the edge of the cover 6, and the foregoing second engagement portion 64 on the base 6 can be an aperture corresponding to the block, as shown in FIG. 3. Of course, the engagement relationship between the cover 4 and the base 6 is not limited to the foregoing engagement form. For example, in another embodiment of the invention, the foregoing first engagement portion 46 on the cover 4 can be an aperture inversely, and the foregoing second engagement portion 64 on the base 6 can be a block corresponding to the aperture. Or, in another embodiment of the invention, the foregoing first engagement portion 46 on the cover 4 can be a shaft member which is extended from the portion adjacent to the edge of the cover 6, and the foregoing second engagement portion 64 on the base 6 can be a bearing member which can accommodate the shaft member (not shown in figures).

Figure 4B:
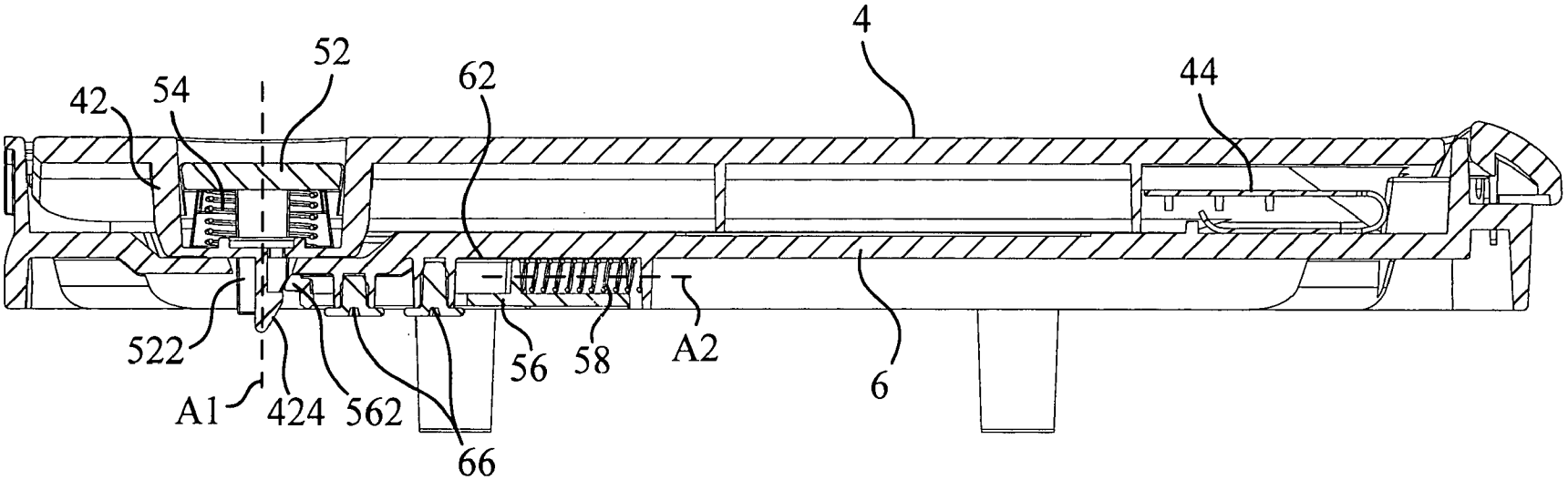
FIG. 4B is a cross-sectional view illustrating the lock device in FIG. 2, wherein the first sliding member compresses the first elastomer along the first axle.

Please refer to FIG. 4B. FIG. 4B is a cross-sectional view illustrating the lock device in FIG. 2, wherein the first sliding member 52 compresses the first elastomer 54 along the first axle A1. With the proper arrangements among components, when the first sliding member 52 slides toward the base 6 along the first axle A1, the column 522 on the sliding member 52 will push the second retainer 562 on the second sliding member 56 to make the second sliding member 56 to slide along the second axle A2, so as to make the second retainer 562 separate from the first retainer 424 and release the original lock situation. It is needed additional explanations that the first elastomer 54 includes a first compression stroke. And, when the first sliding member 52 compresses the first compression stroke of the first elastomer 54 along the first axle A1, the second retainer 562 which is pushed by the column 522 on the first sliding member 52 will separate the first retainer 424 simultaneously. It is needed to be pointed out that the first elastomer 54 is not completely compressed at this time.

Besides, the lock device of the invention can further include a second elastomer 58, as shown in FIG. 4B. The second elastomer 58 is disposed between the base 6 and the second sliding member 56 along the second axle A2. Thus, the second elastomer 58 can push the second sliding member 56 toward the first sliding member 52 along the second axle A2 during the time of locking the first retainer 424 to the second retainer 562. It can be known that the major function and objective is to make the second sliding member 56 return back to its original position after the cover 4 performs the actions of "locking" or "releasing" relative to the base 6 so that the first retainer 424 on the first sliding member 52 can perform the actions of "locking" or "releasing" repetitively.

It is needed additional explanations that the cover 4 which was in the lock situation originally can be taken off to separate the base 6 by hands after the first sliding member 52 compresses the first compression stroke of the first elastomer 54. However, if the first sliding member 52 is released without taking off the cover 4, the second sliding member 56 will return back to the lock situation again since the second elastomer 58 pushes the first sliding member 52. Therefore, in an embodiment, the cover 4 can further include a third elastomer 44. As shown in FIG. 4A, the third elastomer 44 is compressed between the cover 4 and the base 6 when the cover 4 is mounted to the base 6.

Figure 4C:
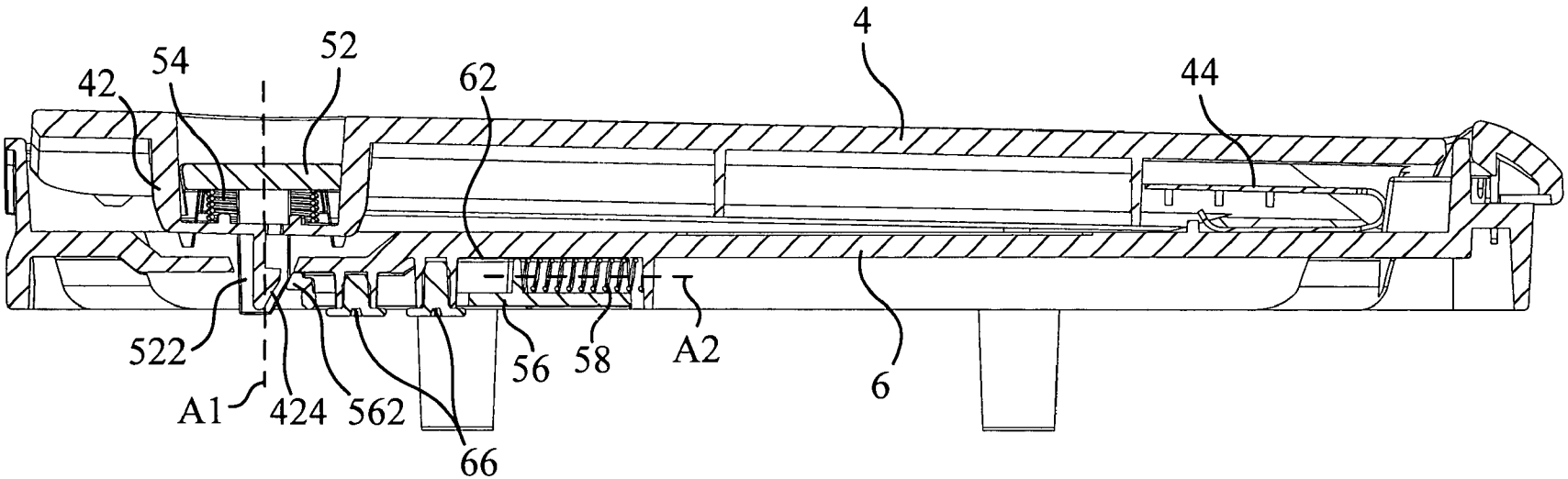
FIG. 4C is a cross-sectional view illustrating the lock device in FIG. 2, wherein the third elastomer pushes the cover to compress the first elastomer along the first axle.

Please refer to FIG. 4C. FIG. 4C is a cross-sectional view illustrating the lock device in FIG. 2, wherein the third elastomer 44 pushes the cover 4 to compress the first elastomer 54 along the first axle A1. It is needed additional explanations that the first elastomer 54 can further include a second compression stroke. When the second retainer 562 which is pushed by the column 522 on the first sliding member 52 separates the first retainer 424, the compressed third elastomer 44 can push the cover 4 to compress the second compression stroke of the first elastomer 54 along the first axle A1, so as to make the cover 4 separate the base 6. It can be known that by disposing the third elastomer 44 between the cover 4 and the base 6, it is unnecessary to worry that the second sliding member 56 will return back to the lock situation again since the second elastomer 58 pushes the first sliding member 52 (If the first sliding member 52 is released without taking off the cover 4). Contrarily, after pressing the first sliding member 52 to make the first retainer 424 and the second retainer 562 release from the lock situation, the elastic force of the compressed third elastomer 44 will push the cover 4 along the first axle A1 to compress the first elastomer 52, so as to make the cover 4 separate from the base 6.

Figure 4D:
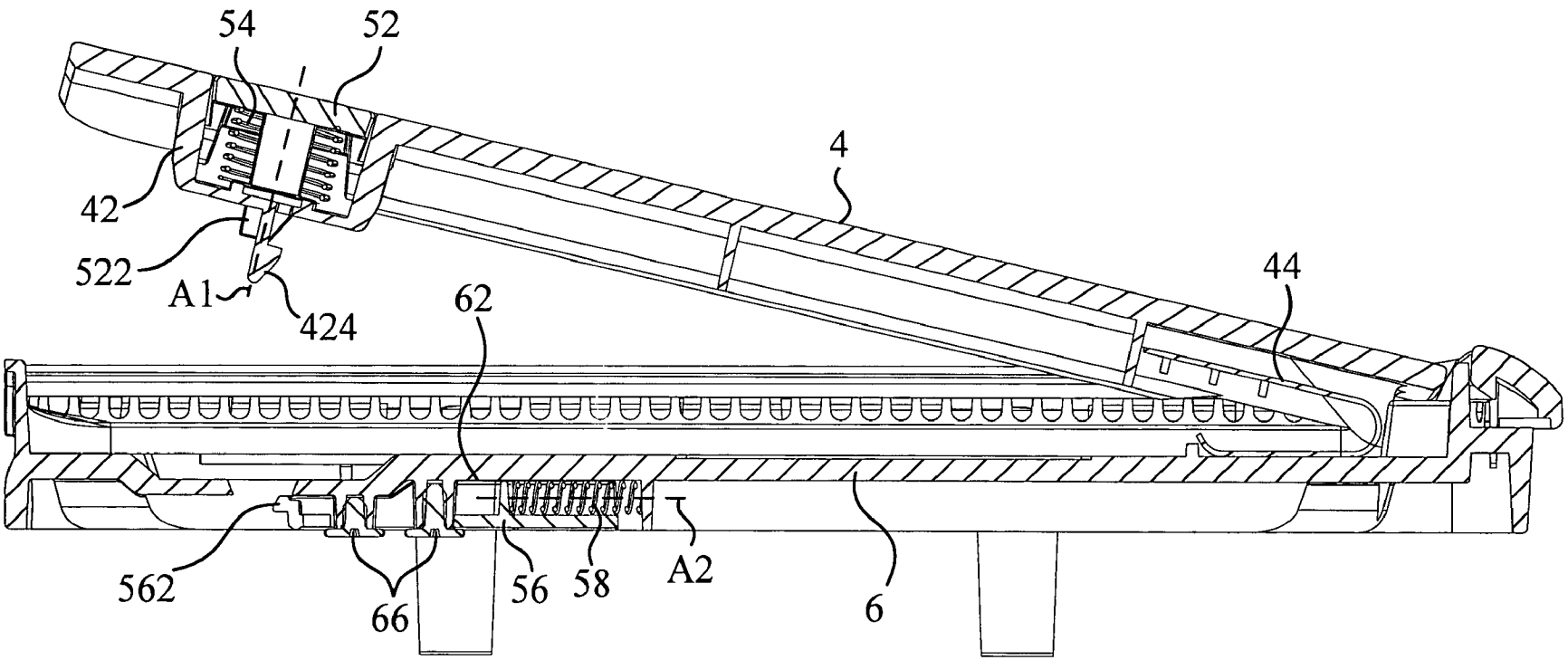
FIG. 4D is a cross-sectional view illustrating the lock device in FIG. 2, wherein the third elastomer pushes the cover to separate the base.

Subsequently, please refer to FIG. 4D. FIG. 4D is a cross-sectional view illustrating the lock device in FIG. 2, wherein the third elastomer 44 pushes the cover 4 to separate the base 6. It is needed additional explanations that when the first sliding member 52 is completely released, the first elastomer 54 can recover its first compression stroke and second compression stroke. Also, the column 522 on the first sliding member 52 will release the situation of pushing the second retainer 562 on the second sliding member 56. Furthermore, because the first engagement portion 46 on the cover 4 and the second engagement portion 64 on the base 6 are still in engagement, the cover 4 will rise substantially relative to the second engagement portion 64 by regarding the second engagement portion 64 as an axle after the elastic force of the third elastomer 44 is released. Accordingly, the cover 4 of the lock device of the invention will jump up after being released, which can greatly increase the convenience of taking the cover 4 off.

It is needed to be emphasized again that the foregoing first elastomer 54 mainly includes the first compression stroke and the second compression stroke. When the first sliding member 52 compresses the first compression stroke of the first elastomer 54 along the first axle A1, the second retainer 562 which is pushed by the column 522 on the first sliding member 52 will separate the first retainer 424 simultaneously. Furthermore, when the second retainer 562 which is pushed by the column 522 on the first sliding member 52 separates the first retainer 424, the compressed third elastomer 44 can push the cover 4 to compress the second compression stroke of the first elastomer 54 along the first axle A1, so as to make the cover 4 separate the base 6. It can be known that the major spirit of the invention is to design the first compression stroke and the second compression stroke on the first elastomer 54 so that the release button (i.e., the first sliding member 52) can be disposed on the cover 4 rather than on the base 6 far from the cover 4 (i.e., the foregoing known approach). It is needed additional explanations that the ratio between the first compression stroke and the second compression stroke of the first elastomer 54 can be designed to be, but not limited to, 6:4. That is to say, the ratio is designed according to the needs of the practical design.

In an embodiment, the foregoing first elastomer 54 is, but not limited to, a first spring, the foregoing second elastomer 58 is, but not limited to, a second spring, and the foregoing third elastomer 44 is, but not limited to, a clip spring. In a word, if the materials (e.g., rubber) or the components (e.g., torsion spring) can provide enough elastic force, they can be embodied in the foregoing first elastomer 54, the second elastomer 58, and the third elastomer 44 of the invention.

In an embodiment, the first axle can be, but not limited to, perpendicular to the second axle. The angle between the first axle A1 and the second axle A2 can be determined based on the space design in the practical application. And, the functions of the invention will not be influenced.

It is needed additional explanations that in order to prevent the first sliding member 52 which is accommodated in the recess 42 of the cover 4 from separating from the recess 42, the first sliding member 52 can has at least one first retaining member 524, as shown in FIG. 3. Thereby, the at least one first retaining member 524 can be used for retaining the first sliding member 52 during the time that the first elastomer 54 supports the first sliding member 52. In the embodiment, the at least one retaining member 524 can be at least one hook. Besides, the recess 42 can further form at least one side hole 426, corresponding to the at least one hook, for the at least one hook to lock, so as to make the first sliding member 52 not separate the recess 42. But the lock device of the invention is not limited to the above-mentioned design. For example, it can derive the same result by inversely forming at least one side hole 426 on the first sliding member 52 and disposing at least one hook on the recess.

Similarly, in order to prevent the second sliding member 56 which can slide in the groove 62 of the second sliding member 56 from separating from the base 6, the base 6 can further include at least one second retaining member 66, as shown in FIG. 3. Thereby, the least one second retaining member 66 can be used for retaining the second sliding member 56 during the time that the second sliding member 56 slides along the second axle A2. Furthermore, in the embodiment, a second hole 564 can be formed on the second sliding member 56, and the at least one second retaining member 66 can pass through the second hole 564 to mount to the base 6 and retain the second sliding member 56 between the base 6 and the at least one second retaining member 66, as shown in FIG. 4A. In an embodiment, the at least one second retaining member 66 can be, but not limited to, a screw bolt.

With the foregoing detail descriptions of the preferred embodiments of the invention, it can be clearly known that the release button and cover of the lock device according to the invention are integrally designed, so as to make the cover lock the base firmly. Moreover, by controlling the particular spring stroke which is designed under the release button, the function of taking off the cover under the release situation can be achieved. Not only the problem of being not able to dispose a release button on the cover in the past can be solved, but also the problem of switching to release situation owing to an unexpected crash can be solved.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A device comprising:

a base having a groove;

a cover having a first edge and an opposite second edge, the cover is pivotally connected with the base at the first edge thereof and having a recess at the opposite second edge thereof, the recess having a first hole formed on a bottom thereof;

a first retainer disposed on the bottom of the recess;

a first sliding member, adapted to be accommodated in the recess, being capable of limitedly sliding along a first axle perpendicular to the cover;

a column, which is formed on the first sliding member, being capable of passing through the first hole when the first sliding member slides;

a first elastomer, disposed between the cover and the first sliding member, providing a first resilient force for the first sliding member along the first axle;

a second sliding member, adapted to be accommodated in the groove, being capable of limitedly sliding along a second axle perpendicular to the first axle; and a second retainer disposed at a first end of the second sliding member;

a second elastomer, disposed between the base and the second sliding member, providing a second resilient force for the second sliding member along the second axle;

wherein when the opposite second edge of the cover is locked to the base, the second retainer engages the first retainer of the cover by the second resilient force, when the first sliding member slides toward the base along the first axle, the column will push the second retainer to make the second sliding member to slide against the second elastomer along the second axle, so as to make the second retainer separate from the first retainer and unlock the opposite second edge of the cover from the base.

2. The device of claim 1, wherein the cover comprises a first engagement portion, the base comprises a second engagement portion corresponding to the first engagement portion, the cover is pivotally connected with the base by engaging the first engagement portion to the second engagement portion.

3. The device of claim 1, wherein the cover further comprises a third elastomer which is compressed between the cover and the base when the cover is mounted to the base.

4. The device of claim 3, wherein the first elastomer is a first spring, the second elastomer is a second spring, and the third elastomer is a clip spring.

5. The device of claim 1, wherein the first sliding member has at least one first retaining member for retaining and preventing the first sliding member from separating from the recess.

6. The device of claim 5, wherein the at least one retaining member is at least one hook, the recess has at least one side hole for the at least one hook to engage within.

7. The device of claim 1, wherein the base further comprises at least one second retaining member for retaining and preventing the second sliding member from separating from the base.

8. The device of claim 7, wherein the second sliding member has a second hole, the at least one second retaining member engages the second hole to be mounted to the base and retaining the second sliding member between the base and the at least one second retaining member.

9. The device of claim 8, wherein the at least one second retaining member is a screw bolt.

* * * * *